United States Patent [19]

Lienhard

[11] 4,057,943

[45] Nov. 15, 1977

[54] MODULAR SCAFFOLDING FOR ASSEMBLING THE INSIDE OF AN LNG VESSEL

[75] Inventor: Robert W. Lienhard, Pittsburgh, Pa.

[73] Assignee: Swiss Fabricating, Inc., Pittsburgh, Pa.

[21] Appl. No.: 659,991

[22] Filed: Feb. 23, 1976

[51] Int. Cl.[2] ..... E04G 3/02; E04G 11/04

[52] U.S. Cl. ..... 52/126; 52/645; 182/178; 182/179

[58] Field of Search ..... 52/126, 249, 404, 637, 52/638, 645, 646; 220/9 LG, 10, 83; 182/178, 179

[56] References Cited

U.S. PATENT DOCUMENTS

| | | | |
|---|---|---|---|
| 2,911,125 | 11/1959 | Dosker | 220/83 |
| 3,679,026 | 7/1972 | Hansen et al. | 182/128 |
| 3,800,970 | 4/1974 | Jackson | 220/10 |
| 3,948,412 | 4/1976 | Bennett | 52/249 |

FOREIGN PATENT DOCUMENTS

| | | | |
|---|---|---|---|
| 1,577,362 | 8/1969 | France | 52/126 |
| 800,150 | 9/1950 | Germany | 182/128 |
| 447,572 | 3/1968 | Switzerland | 182/179 |
| 863,855 | 3/1961 | United Kingdom | 182/179 |

*Primary Examiner*—James L. Ridgill, Jr.
*Attorney, Agent, or Firm*—Robert D. Yeager; Howard G. Massung

[57] ABSTRACT

A scaffolding arrangement is provided having removable bottom supports and adjustable outriggers for assembling the insulation and inner membrane of a liquefied natural gas (LNG) tank. A structural steel base is provided from which the scaffolding is supported. The structural steel base is supported from the bottom of the LNG vessel by adjustable screw jack supports. The inside of the LNG vessel is coated with various layers of insulating and support material and a final inner layer or membrane of stainless steel is provided over the insulation and other associated material. Any screw jack support can be removed, when adjacent screw jack supports are in place, allowing installation of the insulation and membrane in that area. Vertical supports are provided throughout the inside of the LNG vessel above the structural steel base. A plurality of horizontal spaced apart levels are formed within the LNG vessel to divide the inside of the vessel into a plurality of work platforms. The horizontal work platforms are formed from horizontally disposed structural members which are supported solely from the vertical columns. Thus, no cross bracing is required on the inside of the vessel. Except for the vertical support columns the horizontal work areas or platforms are open. The open work areas permit the easy use of mechanical handling equipment which is required for moving, installing and testing the insulation and corrosion resistant inner layer. The fixed horizontal work platform terminates a distance from the side of the LNG vessel. Adjustable outrigger members are provided between the fixed horizontal work platform and the side of the vessel. These adjustable outrigger members can be extended out to come into close proximity to the side of the vessel. Thus the work platform can be extended as close to the side of the vessel as desired. As the insulating layers on the side of the LNG vessel are built up, the outriggers are retracted accordingly. Thus, at all times the work platform can be close to the point where insulation or stainless steel membrane is being applied or tested. The vertical and horizontal scaffolding have connectors formed integrally therewith for easy connection or attachment to the associated scaffolding members.

11 Claims, 14 Drawing Figures

MODULAR SCAFFOLDING FOR ASSEMBLING THE INSIDE OF AN LNG VESSEL

BACKGROUND OF THE INVENTION

1. Field of the Invention

This invention is related to the construction of liquefied natural gas vessels and more particularly to a unique scaffolding construction and arrangement for finishing the inside of an LNG vessel.

2. Description of the Prior Art

Prior art scaffolding arrangements for the inside of LNG vessels have been specially constructed for each job. They have utilized cross bracing which limits work area mobility and have not provided for adjustable outrigger sections.

The interior of LNG vessels must be finished with a relatively thick coating of thermal insulation which has a built up thickness of around 14 inches. This insulation must be securely attached to the inner walls of the vessel. The insulation comes in relatively large panels. The insulation panels are made of fiber glass, wooden grounds and wooden panels. Some standard sizes of panels are 10′ × 6′ × 7″, 6′ × 6′ × 7″, and 6′ × 4′ × 7″. Angled panels that fit in the corners and ends of the tanks are also supplied. The edges of the panels can be angled so that the installed panels fit the contour of the vessel. Depending on the panel design the size of panel can vary, however, in most instances the panels will be rather large and bulky. For example, a common size panel is 10′ × 6′ × 7″ which weighs around 330 lbs. These panels are usually packed and shipped in units of three having a shipping weight of over 1,000 pounds. It is desirable that the panels not be unpacked until they are ready to be installed. Thus, the handling equipment within the vessel must be capable of moving a package larger than 10′ × 6′ × 21″ and weighing in excess of 1,000 pounds. The scaffolding must be constructed to accommodate the handling equipment and the insulating panels. Each insulating panel is specifically designated for a selected position in the vessel wall.

The inside of the insulation must be covered with a corrosion resistant material which will withstand liquefied natural gas. This corrosion resistant material must also prevent the liquefied natural gas from being contaminated. The material utilized is usually stainless steel or other corrosion resistant material which is formed in panels which are placed on the outside of the insulating layers. The panels are welded together to form a continuous inner stainless steel lining for the vessel. The stainless steel is erosion resistant and prevents the liquefied natural gas from being contaminated. After insulation, the entire inner lining must be completely inspected to determine any leaks or defects. It is desirable that the horizontal levels be relatively open to permit easy movement of men and material. Also the level should be structurally strong to permit the use of machinery such as fork lifts or manipulators which are required for moving, installing, and testing the insulation and inner lining. Studs or other fasteners are attached to the inside of the LNG vessel for holding the insulation in place. Equipment which requires a structurally strong support is utilized for moving and installing the large heavy insulating panels.

SUMMARY OF THE INVENTION

A scaffolding arrangement having large open relatively unobstructed work platforms is provided. A structural steel base is provided which is supported by adjustable members from the bottom of the LNG vessel. Scaffolding is provided from the structural steel base dividing the inside of the LNG vessel into a plurality of spaced apart horizontal platforms. Only vertically disposed structural support scaffolding members are disposed between the horizontal work platforms. The vertically disposed structural supports are designed and placed in such a manner that they don't interfere with the moving and installing of the large insulating panels. The horizontal platforms are formed from horizontal staging or scaffolding members which are only supported from the vertical scaffolding members. The ends of the horizontally disposed scaffolding members have connectors formed integral therewith which are connected to integral connectors formed on the vertical scaffolding members. The disclosed arrangement provides for large horizontal work areas obstructed only by the vertical support columns. This facilitates men, material and machinery movement within the work areas. The staging or work platform areas are relatively strong to carry a large load.

A fixed portion of each layer terminates away from the sides of the LNG vessel. Adjustable outriggers are provided around the periphery of the staging or horizontal platforms for extending the horizontal work area in close proximity to the sides of the LNG vessel. As the insulation and internal membrane is applied, the adjustable outriggers can be retracted accordingly. The adjustable outriggers are constructed to allow for the installation of the entire insulating and projecting layers while at all times keeping the work area in close proximity to the inside of the LNG vessel.

The adjustable supports, which can be screw jacks, for supporting the structural steel base can be removed when adjacent screw jack supports are in place. This allows easy installation of the bottom insulating layers and stainless steel membrane. The screw jacks can be removed by screwing them upward, with their top connected to a support beam so they are raised up permitting the various layers to be installed. A loop which is rigidly connected to the collar of the screw jack is disposed towards the base of the jack to permit easy adjustment of the jack from the support floor.

It is an object of this invention to teach a scaffolding apparatus which provides relatively large and open horizontal work areas, without X - bracing or tie rods which would be in the way of workmen or storage material, having high strength, for installing the inside finishing layers of an LNG vessel.

It is a further object of this invention to teach a scaffolding arrangement for use in an LNG vessel having large horizontal work areas, the periphery of which can be varied to accommodate the installation of insulating and protective layers.

It is a still further object of this invention to teach a scaffolding arrangement for an LNG vessel wherein the scaffolding is supported from adjustable supports which can be removed for installation of insulating and protective layers in the base of the tank.

BRIEF DESCRIPTION OF THE DRAWINGS

For a better understanding of this invention reference may be had to the preferred embodiment exemplary of the invention shown in the accompanying drawings in which.

DESCRIPTION OF THE PREFERRED EMBODIMENT

Figure 1:
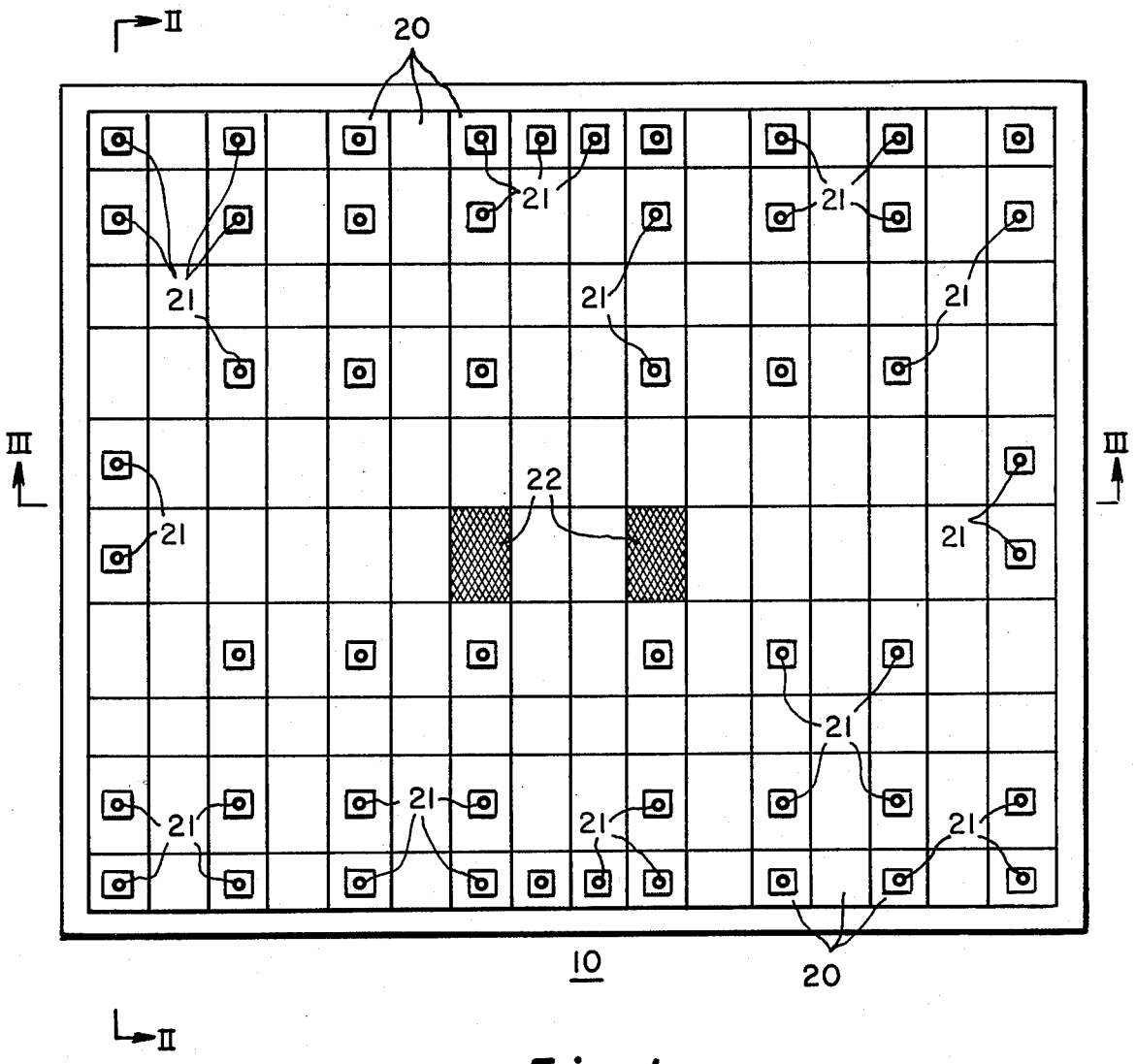
FIG. 1 is a floor plan of an LNG vessel showing the location of screw jacks, insulation and stainless steel panels.
Figure 2:
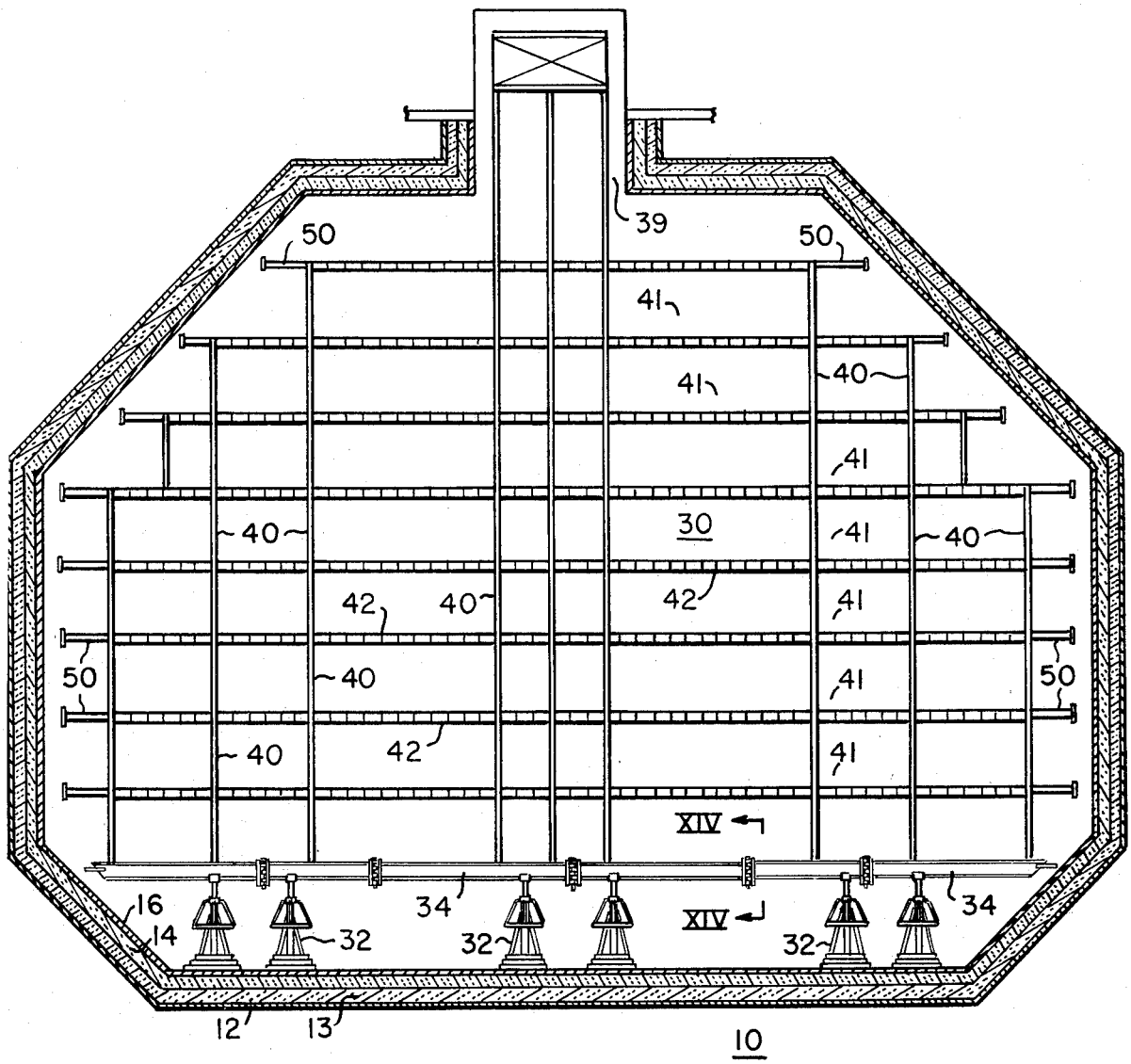
FIG. 2 is an end section view along the line II—II of the LNG vessel of FIG. 1 with the scaffolding apparatus for finishing the inside of the vessel.
Figure 3:
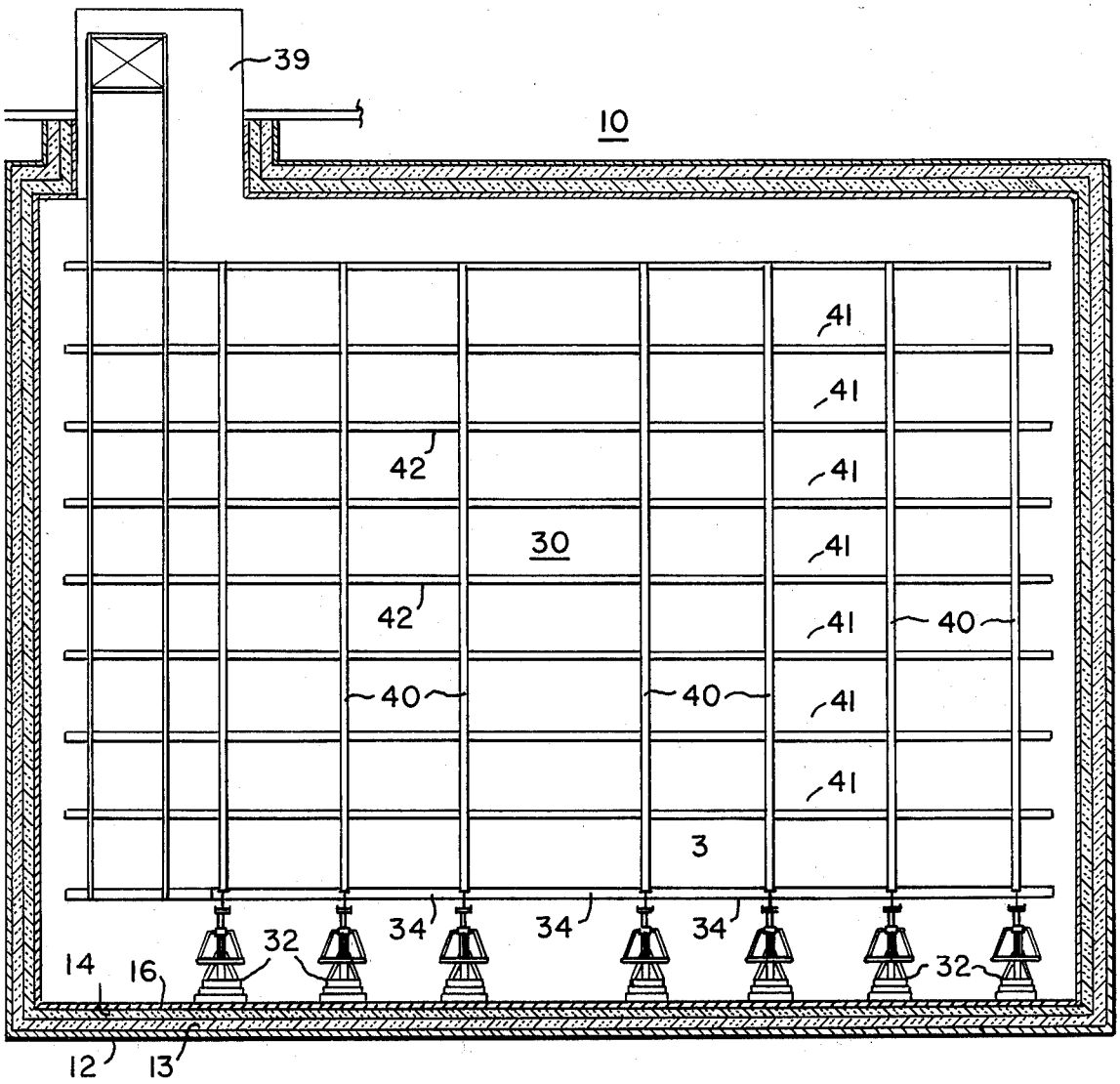
FIG. 3 is a section view of the LNG vessel shown in FIG. 1 along the line III—III with the scaffolding apparatus shown in FIG. 2.

Referring now to the drawings and FIGS. 1, 2 and 3 in particular there is shown scaffolding 30, for finishing the inside of an LNG vessel 10 utilizing the teaching of the present invention. In an LNG vessel for transporting or storing liquefied gas it is necessary that the vessel possess good thermal insulating properties. It is also necessary that the inside of the finished LNG vessel provide a surface which is corrosion resistant to the liquefied natural gas and which will not contaminate the liquefied gas. The LNG vessel 10 is normally constructed from an outer wall 12 which provides structural support for the vessel, inner relatively thick insulating layers 13 and 14 and an inner stainless steel lining 16 which provides a smooth corrosion resistant surface for contact with the stored liquefied gas. It is necessary that the entire inner surface of the LNG vessel 10 be insulated, and the insulation protected by the stainless steel layer 16. The stainless steel layer 16 is formed from a large number of different panels 20 which are welded together to form a continuous stainless steel inner surface. The entire inner stainless steel surface and all the associated welds must be closely inspected to determine any defects or imperfections which could contaminate the liquefied gas. Selected panels 22 provide openings for communication between the liquefied natural gas and the refrigeration system (not shown). The panels and insulation are relatively heavy and machinery such as manipulators and electric fork trucks are required within the LNG vessel for moving and positioning the material. All panels 20 should be not subjected to excessive loads which could cause damage and they should be readily accessible after installation for inspection and testing.

The LNG vessel is rather large, a typical size being 120 feet by 115 feet. The base or bottom is often of a smaller size than the mid-portion and the scaffolding or staging which must rest on the bottom must be constructed to take up this difference. The insulating layers 13 and 14 and the inner panels 20 are attached to the top and sides before the bottom removing some of the weight from the screw jacks 32 before they must be supported from the bottom panels 20. All horizontal platforms 41, even those extending beyond the support jacks 32 must be capable of carrying a significant load without undue movement.

Figure 4:
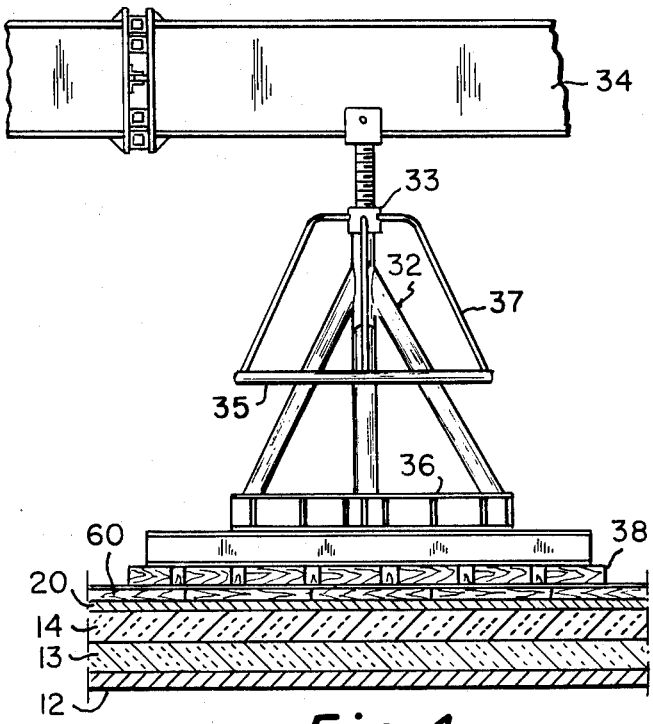
FIG. 4 is a side view of the bottom support screw-jack.
Figure 14:
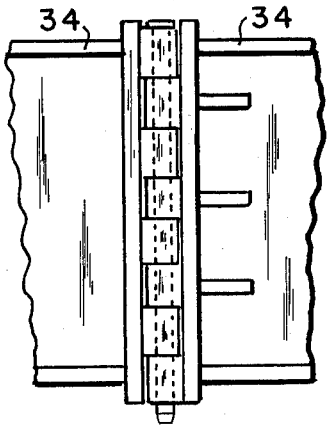
FIG. 14 is a view in FIG. 2 along the line XIV—XIV.

Referring now to FIGS. 2 and 3 there is shown a scaffolding apparatus 30 which is particularly useful for installing the finishing inner layers of an LNG vessel 10. Scaffolding 30 is supported from the bottom of the LNG vessel by adjustable screw jack supports 32. The screw jack supports 32 support a structural steel base 34 from which the scaffolding 30 is erected. The beams which form structural steel base 34 can be interconnected with quick connector square pins as shown in FIGS. 4 and 14. The initial screw jack locations are indicated in FIG. 1 at points 21.

Figure 5:
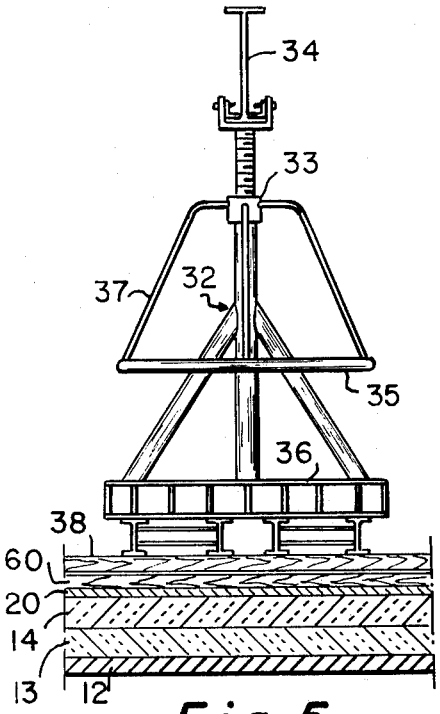
FIG. 5 is a front view of the apparatus shown in FIG. 4.

Referring now to FIGS. 4 and 5 there is shown a more detailed drawing of the screw jack 32. Screw jacks 32 are attached to a structural base 36 which sets on a wood base 38. Planks 60 are provided to cover the installed stainless steel panels 20 to prevent damage thereto. As the various insulating layers 13 and 14 and corrosion resistant panels 20 are installed the screw jacks 32 in that area must be removed. A screw jack 32 is lifted without actually moving it from its proper position by screwing it upward and letting it hang from the structural steel base 34. Screw jack supports 32 are then provided in adjacent areas to take up the load. Thus as the various layers are applied to hull or outer wall 12, screw jacks 32 can be installed and removed as necessary. The structural steel base 34 is held in a fixed position while the height of the screw jack 32 is varied to suit installation of layers such as the planks 60, insulation 13 and 14 or protective panels 20 between the LNG vessel's hull 12 and base 38 of screw jack assembly 32. This arrangement permits all of the work to be accomplished on the bottom floor if the LNG vessel without affecting the work surfaces 41 provided by scaffolding arrangement 30. Screw jacks 32 are normally located in proximity to the center of protective panels 20 to evenly distribute the load thereover. Screw jack 32 has a ring connected by arms 37 to the collar 33 of screw jack 32. Screw jack 32 is large and rather high so it is difficult for a man to turn collar 33 with sufficient force without the ring 35 attached. Without the adapting ring 35 the collar 33 is located at such a height that turning by hand is awkward. To turn the collar without ring 35 it is necessary to use some tool which engages collar 33. These tools can be lost or misplaced, while ring 35 remains permanently attached to collar 33.

Figure 9:
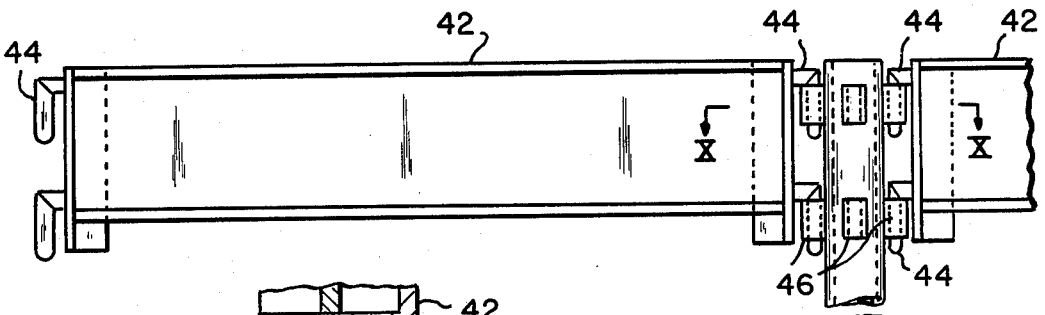
FIG. 9 is a side view showing one of the scaffolding horizontal members connected to one of the vertical members.
Figure 9:
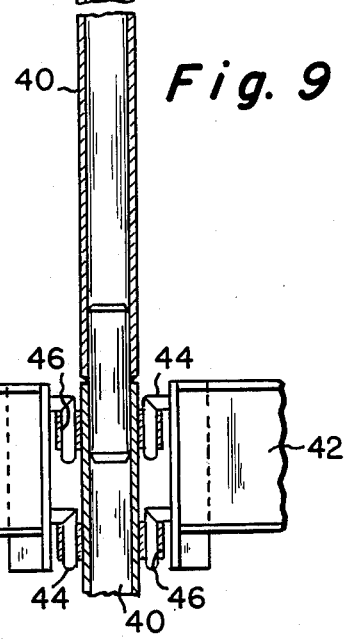
Figure 10:
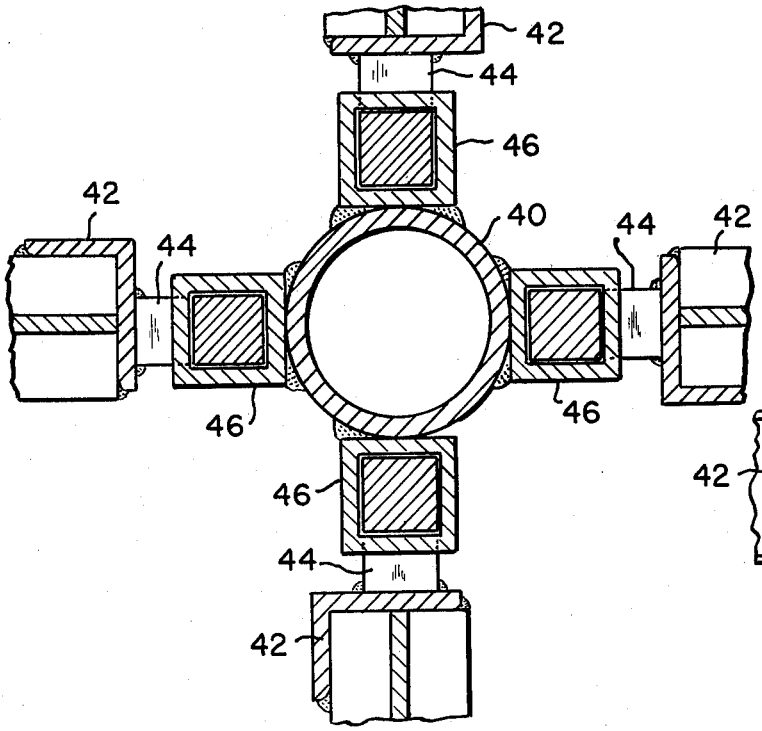
FIG. 10 is a view in FIG. 9 along the line X—X.

Scaffolding 30 as shown in FIGS. 2 and 3 is constructed from a plurality of vertical members 40 which provide vertical support for the scaffolding from structural steel base 34. Horizontal members 42 are supported only from the vertical members 40. That is, no cross bracing between horizontal members 42 of different layers is required other than the support provided by vertical members 40. The ends of each horizontal member 42 are provided with connectors 43 or 44 which engage or are connected to mating receptacles 46 on vertical post 40, as can best be seen in FIG. 9. The ends of horizontal members 42 can be formed with a square tubular member 43 in place of the connector 44 and a securing pin 45 can be disposed therethrough to connect horizontal member 42 to the vertical support post 40. The horizontal members 42 are disposed to divide the inside of the LNG vessel into a number of spaced apart layers or work areas 41. Various other horizontal members can also be used for interconnecting horizontal members 42 on the same work level 41. A wooded work surface is provided by positioning planks 60 across the horizontal members 42 at each level. The work area platform 41 thus constructed provides for easy movement of men, machinery and material. The disclosed construction provides a relatively rigid platform structure which can support heavy loads at each platform level 41. All materials utilized for finishing the inside of vessel 10 come through the top opening 39. An elevator is provided which passes through opening 39 for easy access to each layer. Supporting horizontal members 42 only from the vertical member 40 provides a relatively open work area at each level, obstructed only by the vertical post 40. Cross bracing between the various layers would obstruct movement in the work areas. This is an important consideration where the relatively large amounts of materials must be unloaded, transported, stored and moved on each level. Likewise, due to the magnitude of the job, mechanized handling equipment is required and cross bracing would limit its mobility and usefulness.

The fixed levels defined by the horizontal members 42 terminate a distance from the side of LNG vessel 10. Adjustable outriggers 50 are provided around the periphery of each work level 41 for extending the work area 41 into close proximity to the side of LNG vessel 10. That is, the perimeter of each work area 41 is variable and can be adjusted to accommodate installation of various materials and still remain in close proximity to the sides of LNG vessel 10.

Figure 6:
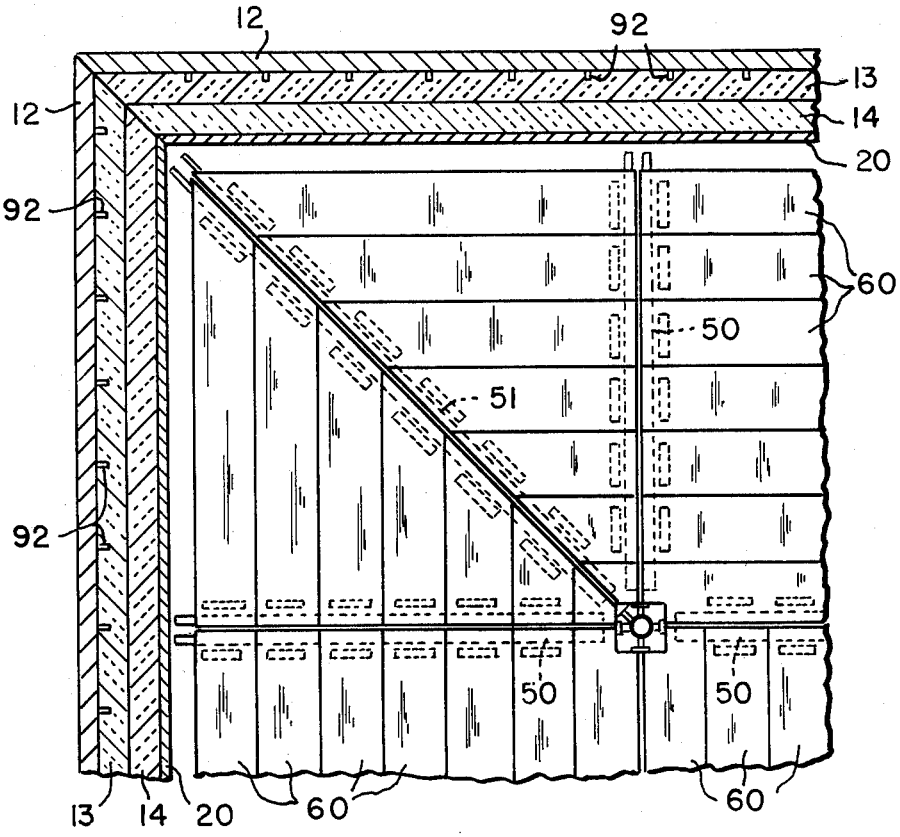
FIG. 6 is a top view of the scaffolding arrangement for the corner of one of the horizontal levels, showing the adjustable outriggers.

FIG. 6 shows a detailed view of the corner arrangement. Planks 60 are provided to be supported from the adjustable outriggers 50. At the corner a longer adjustable outrigger 51 is provided for reaching into the corner as far as necessary. The outrigger is a scaffolding member extending out from a fixed vertical or horizontal member, connected only at one end by a strong connector which prevents movement around the connection axis, such as a SWISS-LOK connection manufactured by Swiss Fabricating, Pittsburgh, Pa. During initial construction with nothing installed on the inside of the LNG vessel 10 the outriggers 50 and 51 are extended to be in close proximity to the wall 12. Planking is provided so that the separation between the wall 12 and any work level 41 is kept relatively small to provide a safe work area.

For installation of the side insulating layers 13 and 14 a plurality of studs 92 are connected to the side wall 12 and the installation 13 is attached thereto. Studs 92 are connected to wall 12 by welding or the like. The attachment of each stud must be tested and this requires a strong support to which pulling equipment for testing is anchored. The disclosed interconnected scaffolding 30 provides the required strong base, and also permits easy movement of the test equipment to different areas.

The insulation 13 and 14 comes in large sheets or panels and power equipment is required for installation. Some of the equipment for positioning, installing and testing the studs 92 also requires a sturdy rigid work area. As the various layers are attached to the walls of vessel 12, the adjustable outriggers 50 can be selectively adjusted backwards to accommodate the added thickness. The outriggers 50 are adjusted backwards to accommodate the various levels attached to wall 12 but the distance at any time between the work level 41 and the wall 12 with or without layers installed is kept small to provide a safe working condition. Outriggers 50 must accommodate a thick insulation layer greater than 14 inches.

Figure 7:
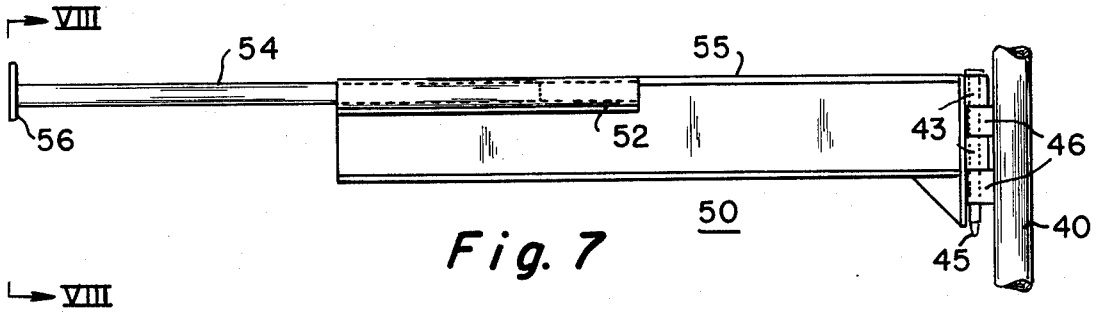
FIG. 7 is a side view of an adjustable outrigger shown in FIG. 6.
Figure 8:
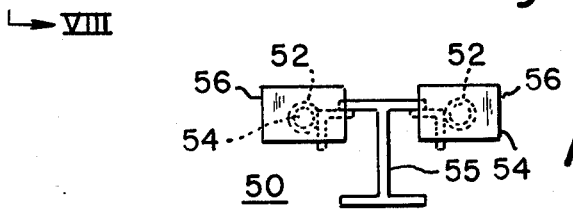
FIG. 8 is a view of the apparatus shown in FIG. 7 along the line VIII—VIII.

As shown in FIG. 7, the adjustable outriggers 50 are formed from an I-beam 55 which has two tubular members 52 attached thereto. Tubular members 52 each support a movable tubular member 54 which can be selectively positioned therein. The end of movable tubular member 54 has a flange 56 formed thereon to engage planks 60 when installed. The adjustable outriggers 50 are also supported only from vertical columns 40 and there is no inner connection required between outriggers 50 of different levels.

Figure 11:
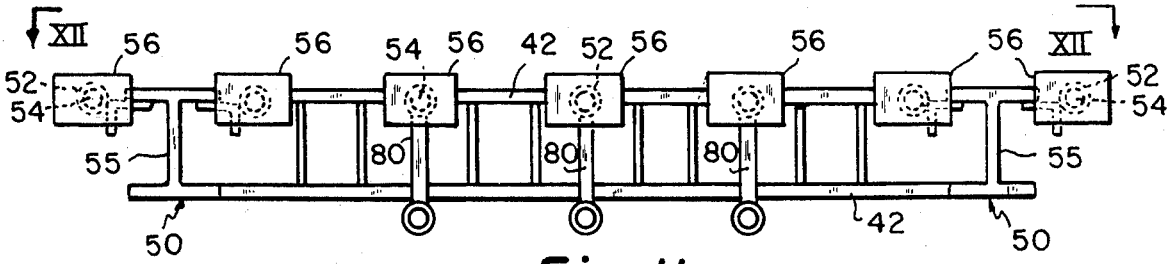
FIG. 11 is a view of a section of outriggers.
Figure 12:
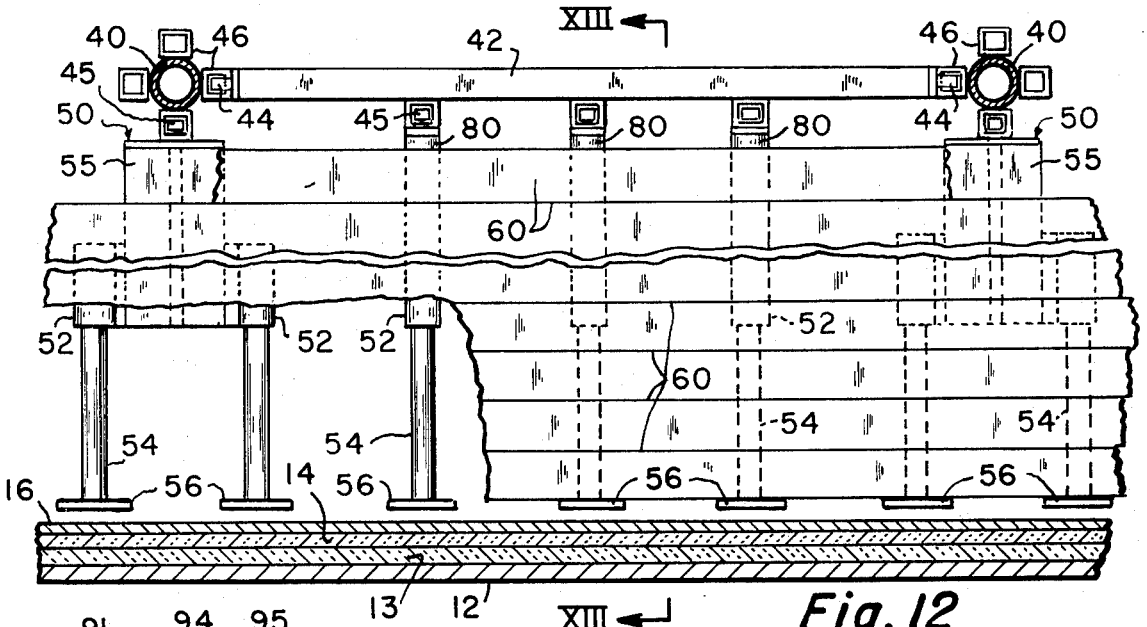
FIG. 12 is a top view of the outriggers shown in FIG. 11 along the line XII—XII.
Figure 13:
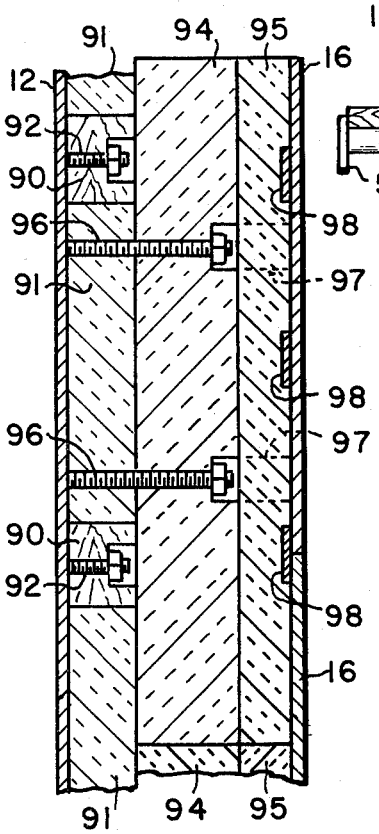
FIG. 13 is a view of a portion of FIG. 12 along the line XIII—XIII.
Figure 13:
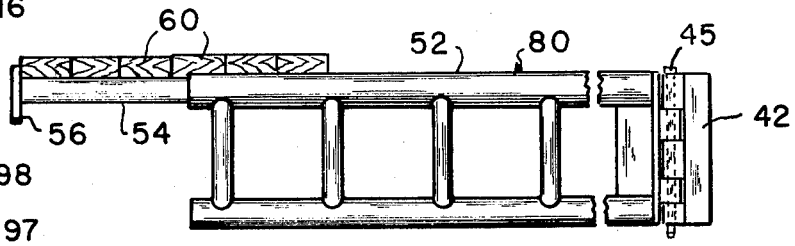

Another type of outrigger 80 is shown in FIGS. 11, 12 and 13. These outriggers 80 are attached to horizontal members 42 which extend between the outer vertical members 40. Outriggers 50 are attached to outer vertical columns 40 with outriggers 80 disposed horizontally therebetween, connected to horizontal member 42. Outrigger 80 comprises a female member 52 which receives tubular member 54. These members provide additional support for planks 60. The disclosed outriggers are formed from standard materials and are of a relatively inexpensive construction. The outer pipe 52 surrounds the movable pipe 54 for a relatively long distance so pipe 54 provides a strong support with little movement. Outriggers 50 and 80 are of the same general length. Outriggers 50 have two supports relatively close together for supporting the ends of planks 60. Thus, the abutting ends of planks 60 are disposed to be supported by outriggers 50. Planks 60 used around the periphery are thus selected to extend between a pair of outriggers 50. Outriggers 80 provide support for planks 60 intermediate their ends.

The outriggers 50 and 80 permit the work level 41 to be in close proximity to the inside of the LNG vessel 10 during all steps of installation. This permits easy installation and testing of the various layers used in finishing LNG vessel 10. The layers can be installed without effecting the basic scaffolding support by adjusting outriggers 50 and 80 to suit. The disclosed scaffolding arrangement does not require a multitude of fasteners for installation. The members are interconnected either by studs 44 engaging square tubes 46 or by a pin 45 passing through square tubes 46 on the members to be joined. This provides a strong interconnection which can be rapidly made and requires a minimum number of tools. This construction, because of its rigid design, also eliminates cross bracing, other than vertical posts 40 between work layers 41. Pins 45 and studs 44 are square and they fit a square tube 46 when assembled to the supported horizontal member is also restrained from pivotal movement about the axis of connection to vertical post 40. This provides for easy assembly of the disclosed scaffolding 30 and assures that all interconnections are maintained perpendicular. The scaffolding 30 can thus not be out of alignment when assembled. Preventing pivotal movement about the point of connection is particularly critical for outriggers 50, 51 or 80 since these are connected to vertical posts 40 or horizontal member 42 at one end only. Also if substantial pivotal movement of outriggers 50, 51, or 80 was permitted this would effect the stability and rigidity of the periphery of work level 41. The disclosed scaffolding apparatus can be sized to accommodate any size of LNG vessel 10. Likewise the disclosed scaffolding is reusable on other jobs.

FIG. 13 shows the cross section of the LNG vessel outer wall 12 in more detail. Wooden supports 90 are connected to hull by short studs 92. Between these supports 90 insulation 91 is applied. Outer insulating layers are installed over layer 91. Long studs 96 secure layer 94 to supports 90. Layer 95 is glued to layer 94. Plugs 97 are installed over studs 96. Inner stainless steel layer 16 is formed of panels 20 which are welded in place. Additional steel pieces 98 may be supplied behind panels 20 to facilitate joining or to provide support.

What is claimed is:

1. Scaffolding apparatus, for use in finishing the interior of an LNG vessel which has a top, bottom and sides, comprising:

a base spaced apart from the bottom of the LNG vessel;

a plurality of adjustable supports disposed between said base and the bottom of the LNG vessel for supporting said base from the bottom of the LNG vessel;

a plurality of vertical columns supported from and extending upward from said base and each of said plurality of vertical columns being formed from a plurality of vertical members;

a plurality of spaced apart horizontal levels each supported only from said plurality of vertical columns and dividing the inside of the LNG vessel into a number of horizontal levels;

each horizontal level comprises a plurality of horizontal members connected to and supported from some of said plurality of vertical columns;

a plurality of adjustable horizontal outriggers, disposed around the periphery of each horizontal level for varying the area defined by each horizontal level, some of said outriggers connected to some of said plurality of vertical columns and the rest of said outriggers connected to some of said horizontal members; and, outrigger connecting means for connecting each outrigger to its associated vertical column or horizontal member and being constructed to prevent pivotal movement about the axis of connection between said outrigger and the associated vertical column or horizontal member.

2. Scaffolding apparatus as claimed in claim 1 wherein said outrigger connecting means comprises:

a square tubular member vertically disposed and attached to said associated vertical column; and, a square male member connected to and fixed with respect to said outrigger engaging said square tubular member attached to said associated vertical column.

3. Scaffolding apparatus as claimed in claim 2 wherein said outrigger comprises:

a beam;

a fixed tubular member rigidly secured to the side of the beam;

a slidable tubular member having a diameter less than that of said fixed tubular member and being partially disposed within said fixed tubular member; and, a stop attached to the free end of said slidable tubular member.

4. Scaffolding apparatus as claimed in claim 3 wherein each of said plurality of adjustable supports comprises a jack screw.

5. Scaffolding apparatus as claimed in claim 4 wherein each screw jack comprises:

an adjustment collar for adjusting said screw jack;

a ring disposed radically outward and downward from said collar; and, joining means for connecting said ring to said adjustable collar for unitary movement therewith.

6. A modular scaffolding apparatus for assembling the inside of an LNG vessel having a bottom, sides, and a top, said modular scaffolding comprising;

a plurality of modular structural members each having integral connectors for engaging other structural members;

said plurality of modular structural members being interconnected to divide the inside of the LNG vessel into a plurality of horizontal levels;

support means for supporting the structural members at each horizontal level comprising only vertically oriented support columns;

a structural steel base supporting said support means;

a plurality of adjustable jack members positionable along said structural steel base and supporting said structural steel base from the bottom of the LNG vessel;

connecting means for connecting the top of each adjustable jack member to the bottom of said base; and, each jack member being movable between a lowered position supporting said base and a raised position hanging said jack member from said base.

7. Modular scaffolding apparatus as claimed in claim 6 wherein:

some of said plurality of structural members are vertically disposed and some are horizontally disposed;

said horizontally disposed members comprise vertically extending studs extending from the ends thereof; and, said vertically disposed members comprise vertically extending square tubular female members for engaging the square studs of said horizontally disposed member to support said horizontally disposed member from said vertically disposed member.

8. Modular scaffolding apparatus as claimed in claim 6 wherein said adjustable jack member comprises:

a collar for adjusting the height of said adjustable jack member;

a ring disposed radially outward and longitudinally away from said collar; and, connecting means for connecting said collar to said ring.

9. Modular scaffolding apparatus as claimed in claim 6 comprising:

a plurality of adjustable outriggers disposed around the periphery of each level; and, each adjustable outrigger comprises a fixed tubular member, a movable tubular member partially disposed within said fixed tubular member and being movable relative thereto, and a stop plate attached to the free end of said movable tubular member.

10. Modular scaffolding apparatus as claimed in claim 6 wherein:

said plurality of modular structural members form a plurality of levels which are spaced apart from the side of the LNG vessel; and comprising, adjustable outrigger members disposed around the periphery of each level between the associated level and the side of the LNG vessel.

11. Modular scaffolding apparatus as claimed in claim 10 wherein:

said adjustable outrigger members can be adjusted over a range greater than 14 inches.

* * * * *